US005538128A

United States Patent [19]

Stierll et al.

[11] Patent Number: 5,538,128

[45] Date of Patent: Jul. 23, 1996

[54] GRATE FOR A FURNACE

[75] Inventors: Guido P. Stierll, Zurich; Hansruedi Steiner, Wettingen, both of Switzerland

[73] Assignee: W + E Umwelttechnik AG, Zurich, Switzerland

[21] Appl. No.: 324,658

[22] Filed: Oct. 18, 1994

[30] Foreign Application Priority Data

Oct. 21, 1993 [CH] Switzerland ..... 93/3173

[51] Int. Cl.[6] ..... B65G 25/00

[52] U.S. Cl. ..... 198/773; 110/281; 126/175; 126/152 R

[58] Field of Search ..... 198/773, 777; 414/156; 432/134, 239; 110/281–283, 289–291, 328; 126/152 R, 152 A, 152 B, 163 R, 174, 175

[56] References Cited

U.S. PATENT DOCUMENTS

| | | | |
|---|---|---|---|
| 4,018,168 | 4/1977 | Andreoli et al. | 126/174 |
| 4,239,029 | 12/1980 | Martin et al. | 126/152 R |
| 4,450,952 | 5/1984 | Steiner | 198/773 |
| 4,548,139 | 10/1985 | Weber | 126/175 |
| 4,776,287 | 10/1988 | Moreau | 198/775 |
| 5,377,663 | 1/1995 | Cole et al. | 126/175 |

FOREIGN PATENT DOCUMENTS

| | | | |
|---|---|---|---|
| 0165432 | 12/1985 | European Pat. Off. | F23H 17/00 |
| 2808057 | 6/1979 | Germany | F23H 17/12 |

*Primary Examiner*—Joseph E. Valenza
*Attorney, Agent, or Firm*—Cushman Darby & Cushman

[57] ABSTRACT

For the detachable fastening of the grate bars (4) of a grate for refuse incineration plants, the edge bars of the fixed bar rows (3), which are composed of grate bars arranged side by side and coupled in pairs in each case by a bolt (12) fastened on one grate bar (4) and at the neighboring grate bar projecting through a longitudinal slot (14), are in the form of fastened grate bars (4') and are fastened relative to the side wall by a swivelling prevention fastening, which with a bolt (12') corresponds to the coupling between neighboring grate bars and at the same time can be in the form of a longitudinal fastening and has clamping means which are releasable from the region situated outside a side cheek (2) and which subject the bolt (12') to a pull directed towards the side wall, or else by a correspondingly releasable swivelling prevention and longitudinal fastening. In the case of a fastening serving solely for swivelling prevention, an additional longitudinal fastening is provided, which is releasable from the region situated outside the side wall and is, for example, in the form of a retractable locking means projecting into a bore in the fixed grate bar (4') and anchored to a side cheek (2), and after the release of which the fastened grate bar (4') can be pushed forward and disconnected from the swivelling prevention fastening.

26 Claims, 10 Drawing Sheets

GRATE FOR A FURNACE

Figure 1:
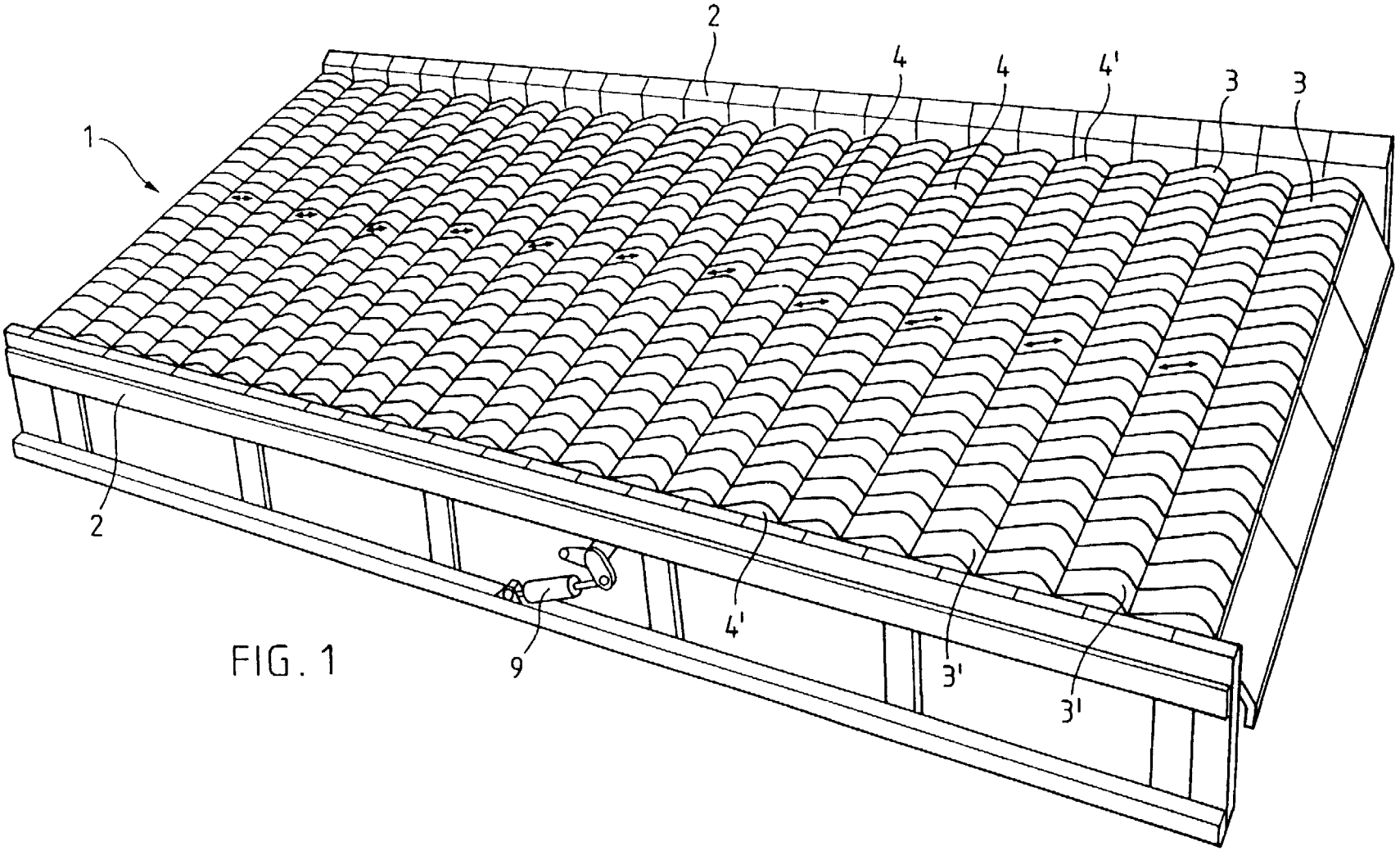

The invention relates to a grate for a furnace according to the pre-characterizing clause of Claim 1. Grates of this kind are used for the incineration and simultaneous further conveying of material to be burned, and are mainly employed in refuse incineration plants.

From DE-C-28 08 057 a grate of this kind is known, which has at the edge a holding device which is fastened to a side cheek and by which the lateral movability of an edge bar towards the centre of the grate is limited. However, it allows the edge bar vertical clearance, which in one embodiment is even unlimited in the upward direction.

Vertical clearance can easily, and of course particularly so in the last-mentioned case, have the consequence that an entire row of grate bars is gradually swivelled upwards about the grate bar holder, on which the grate bars rest in the region of their rear ends, when material to be burned penetrates under the front ends of the grate bars. This is a self-intensifying process, which in addition leads to local intensification of the under-grate blast and therefore to unequal combustion with local excessive temperatures and to the falling of material to be burned into the under-grate blast region and consequently to the soiling of the latter.

On the other hand, in the case of limited vertical clearance it is possible to swivel up and remove grate bars for maintenance purposes only if the holding device is released. In the known arrangement, however, this can be done only from the under-grate blast region, which makes maintenance very difficult.

Here the invention is to provide a remedy. The invention, as characterized in the claims, supplies a grate in which the rows of grate bars are reliably fastened in respect of their angular position and thus the upward swivelling of an entire row of grate bars is reliably eliminated, while the upward swivelling of rows of grate bars and the removal of grate bars for maintenance purposes is immediately possible, without maintenance personnel having to enter the under-grate blast region to do this.

The advantages achieved through the invention are above all to be seen in that the operational reliability of the furnace is substantially increased. Undesired movements of grate bars cannot occur. They are so completely fastened that no undesired gaps, which impair combustion and allow the passage into the under-grate blast region of material to be burned, cannot be formed and that the width of the air gap between them a decisively important factor for uniformity of combustion - is always under control. At the same time, the cost of maintenance is reduced because access to the under-grate blast region, situated directly under the grate bars, is not necessary for the removal of a grate bar, since all steps necessary for the purpose can be taken from the region at the side of the grate and that situated under a middle beam, where that exists, and on the surface of the grate. These advantages give rise to a substantial reduction of operating costs.

Figure 2:
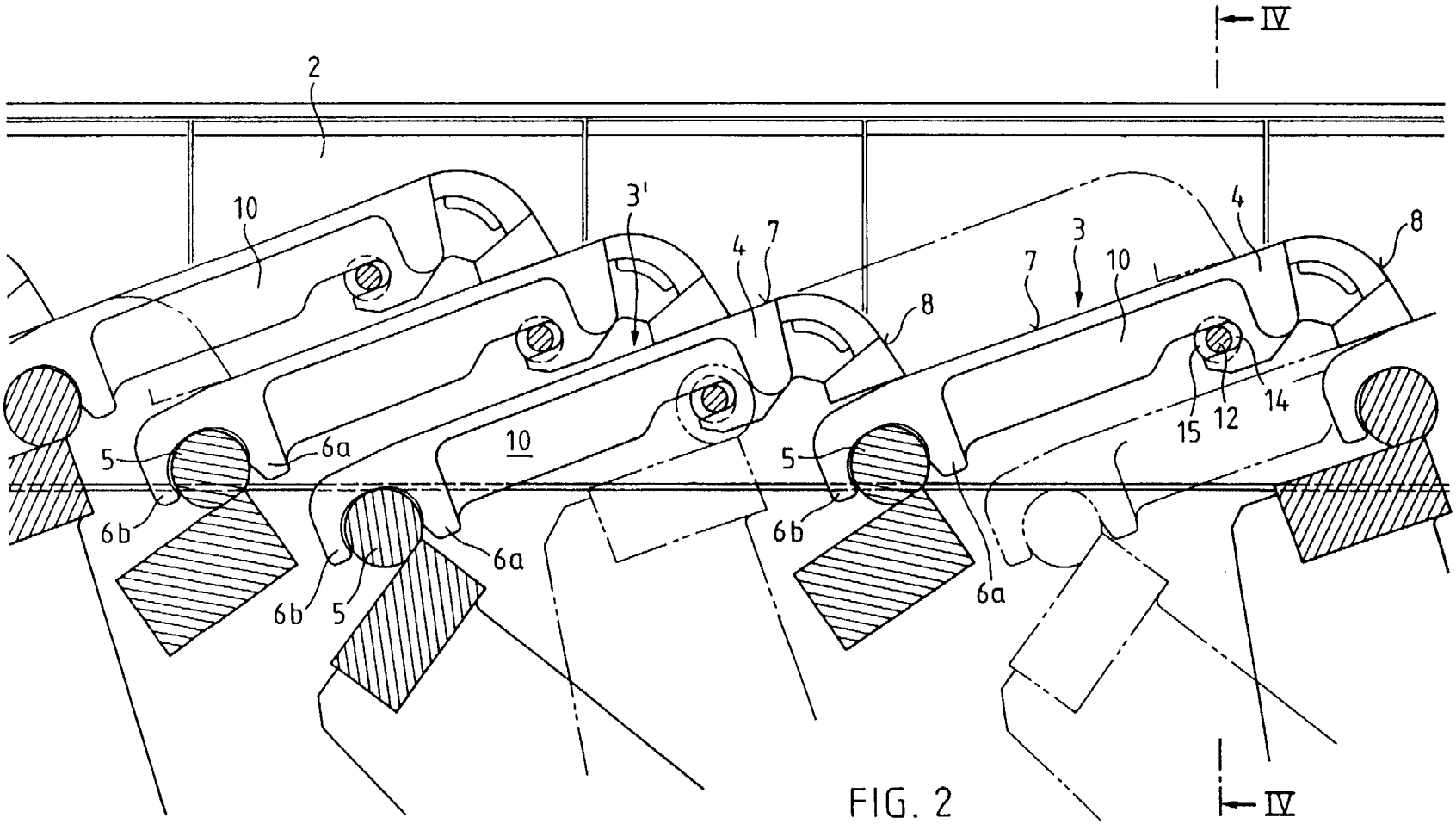
Figure 3:
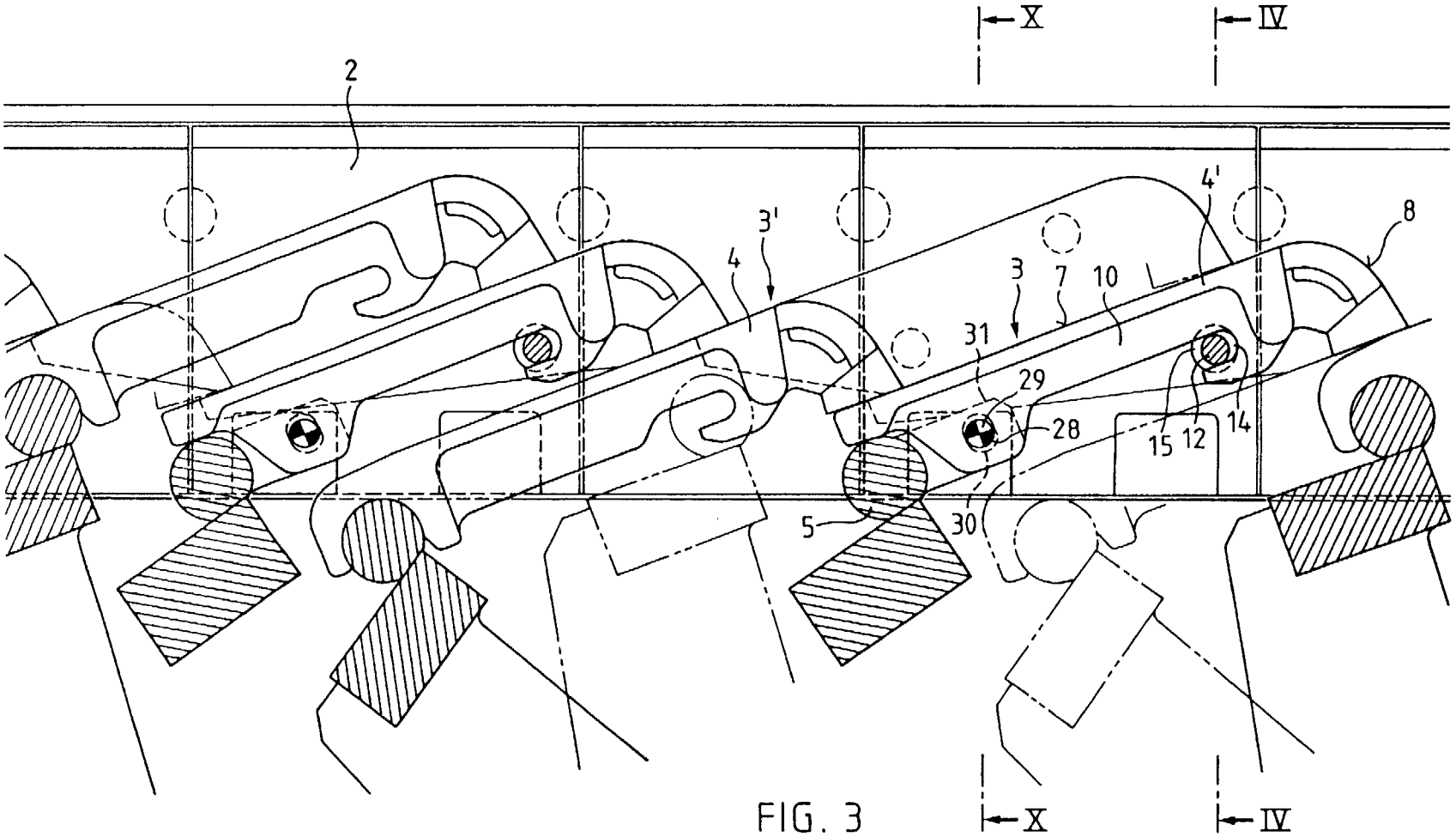
Figure 4:
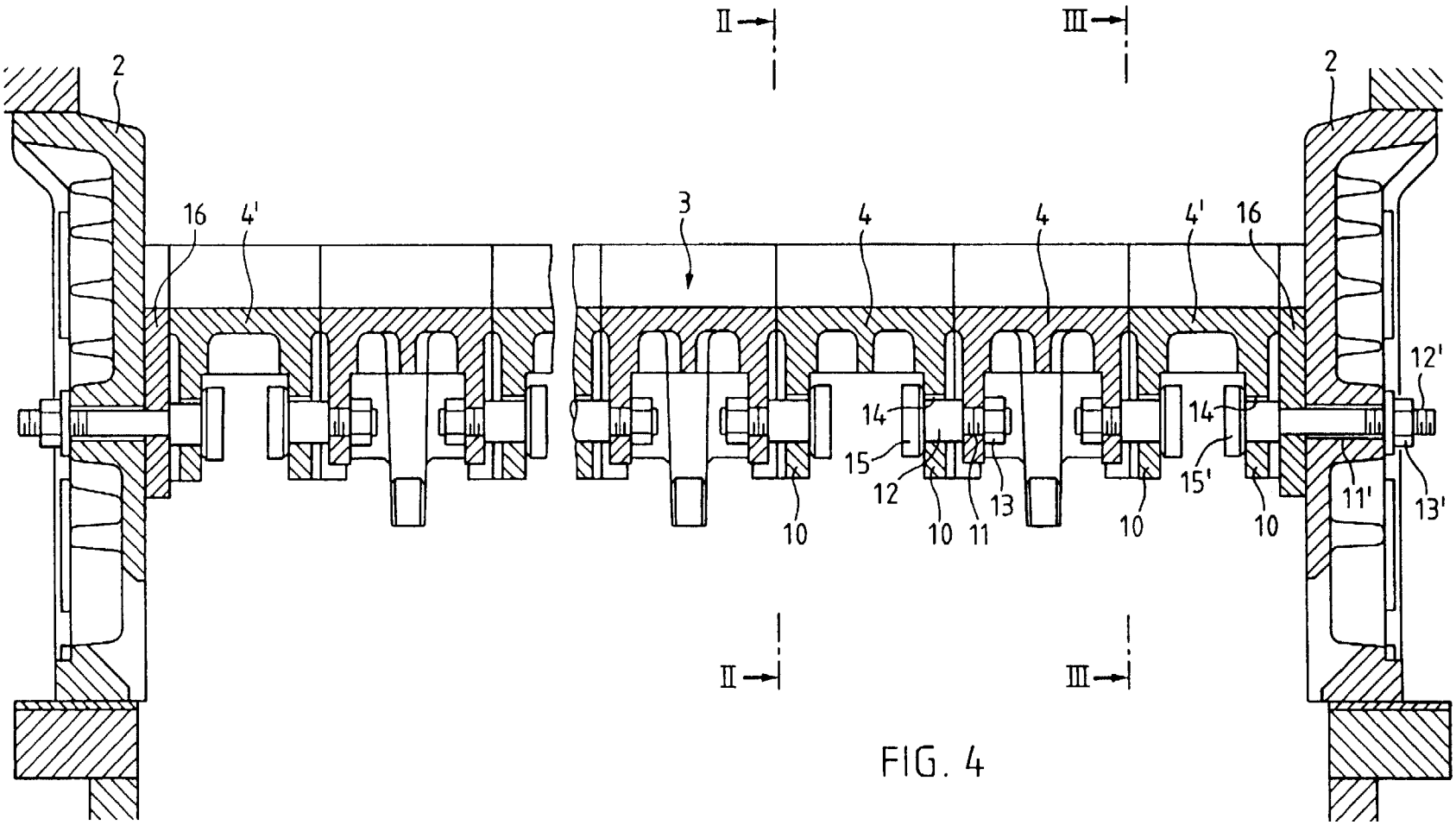
Figure 6:
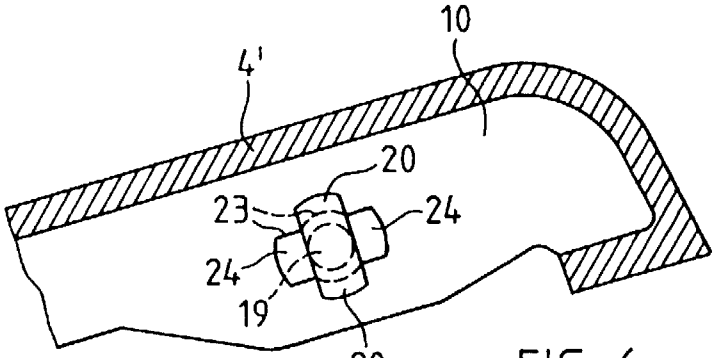
Figure 7:
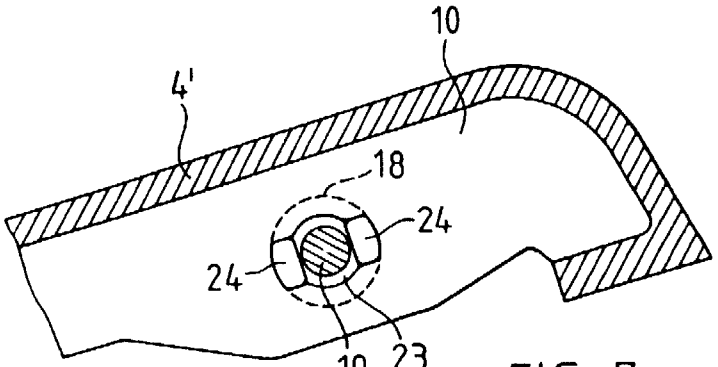
Figure 5:
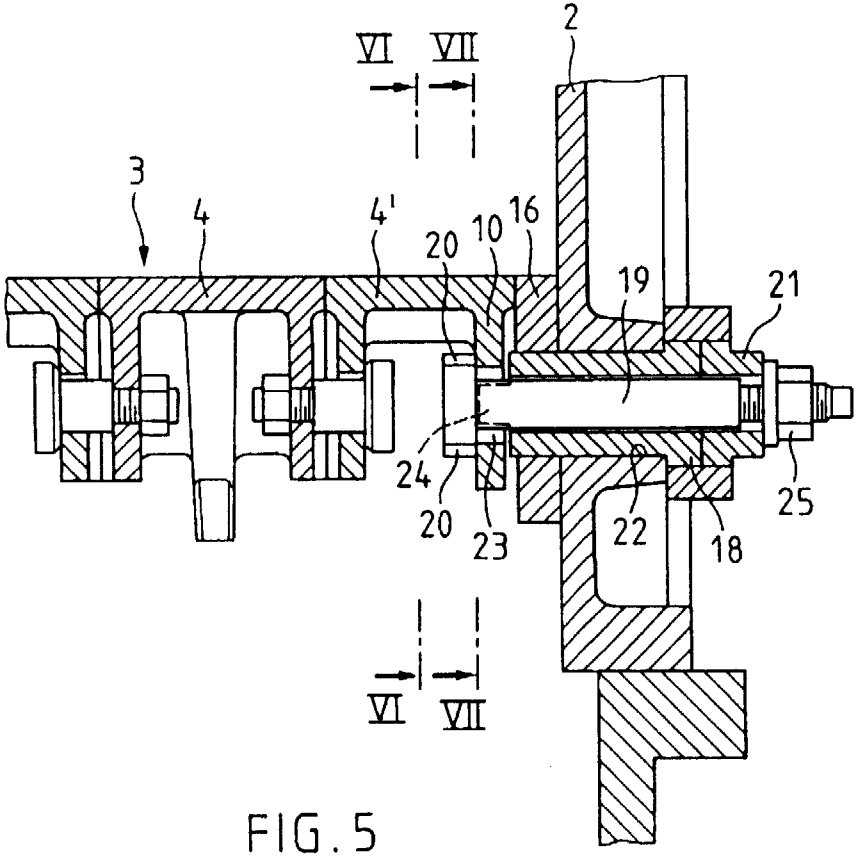
Figure 9:
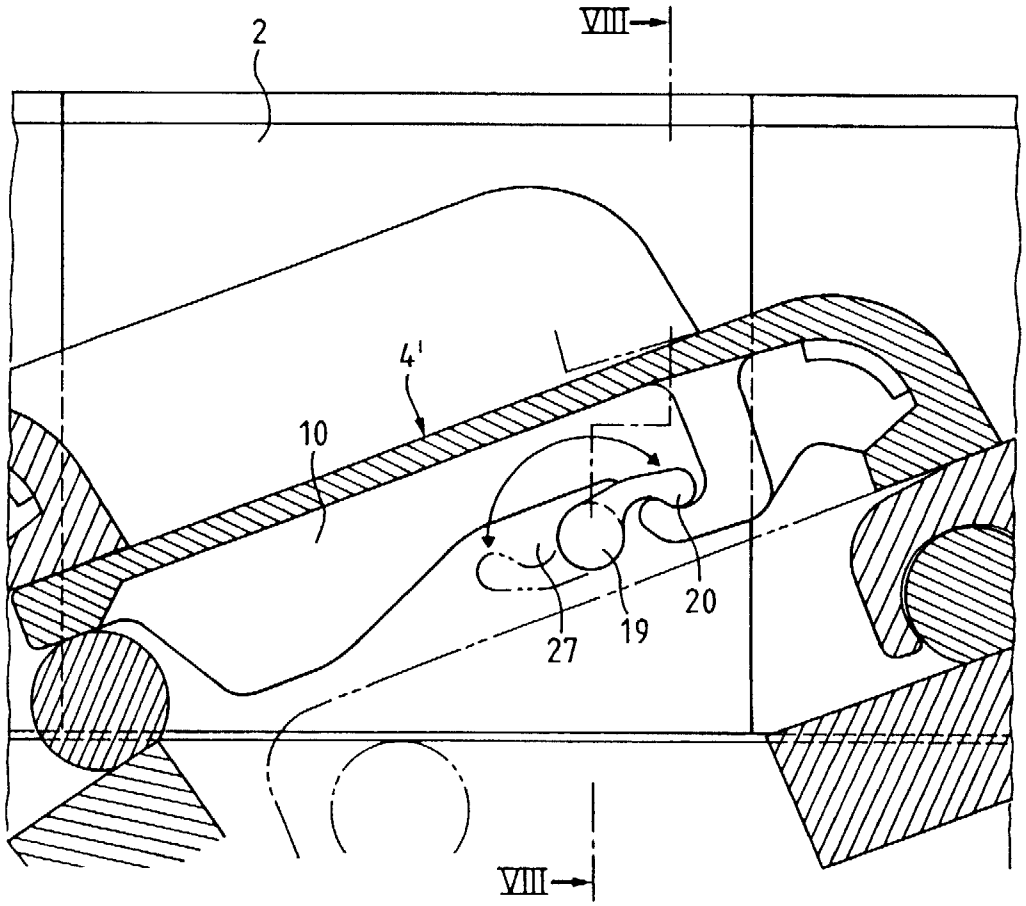
Figure 8:
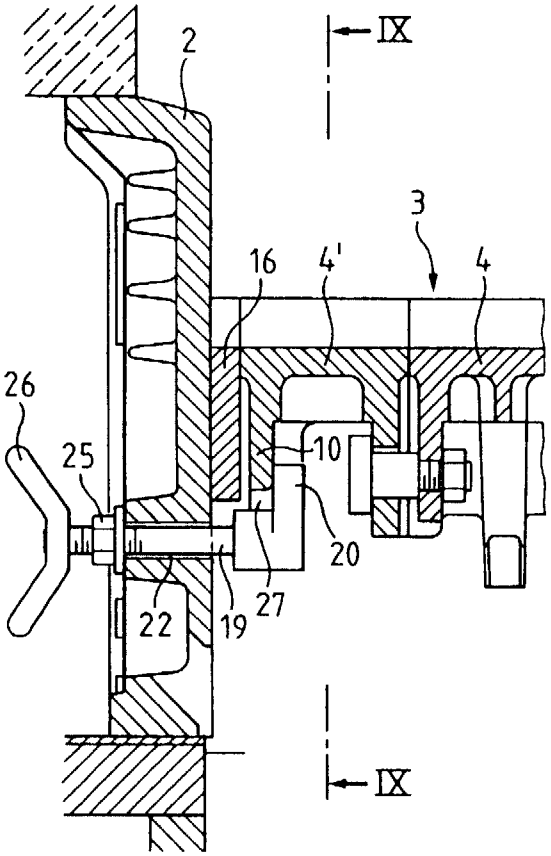
Figure 10:
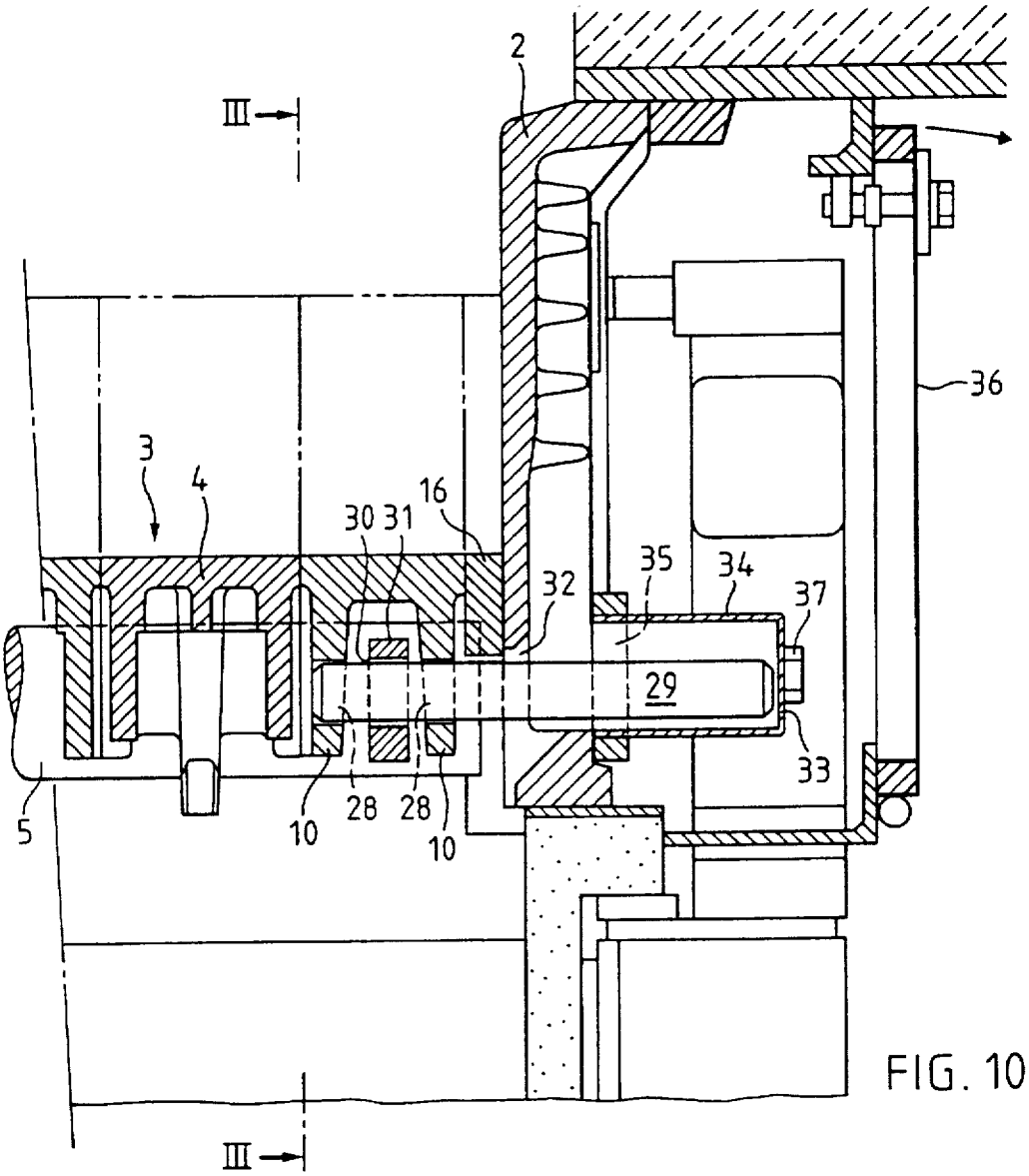
Figure 10A:
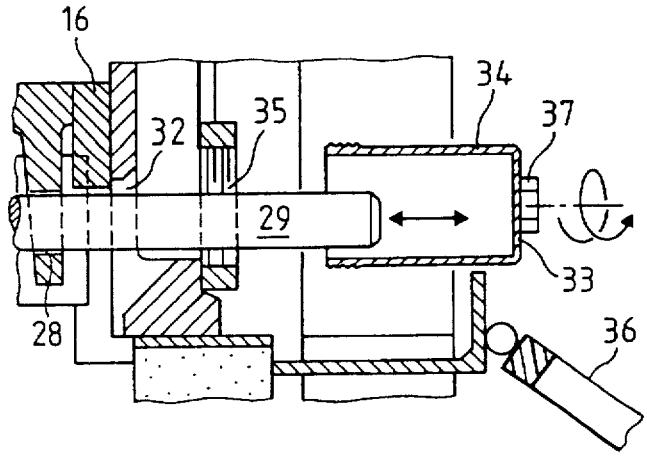
Figure 11:
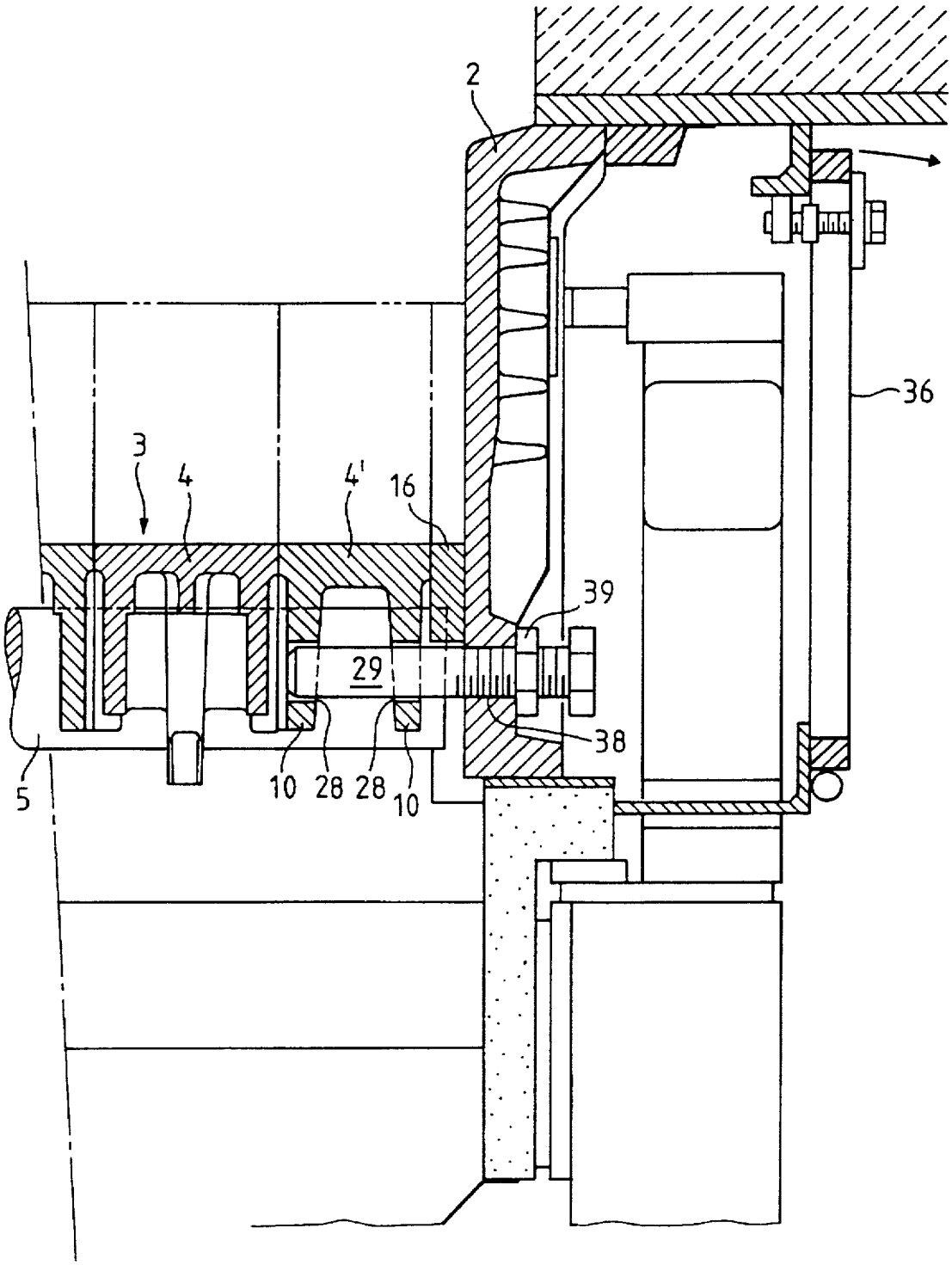
Figure 12:
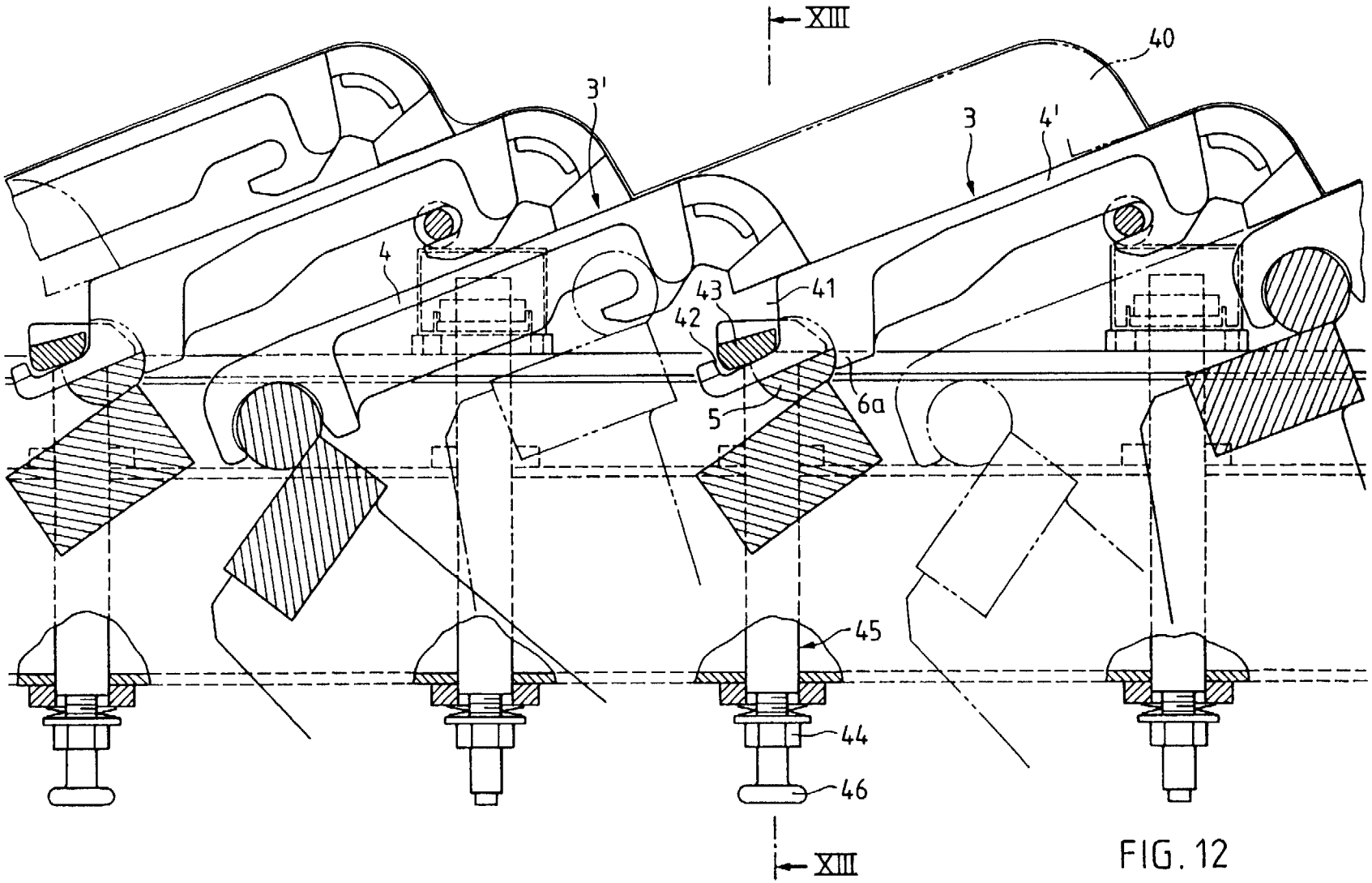
Figure 13:
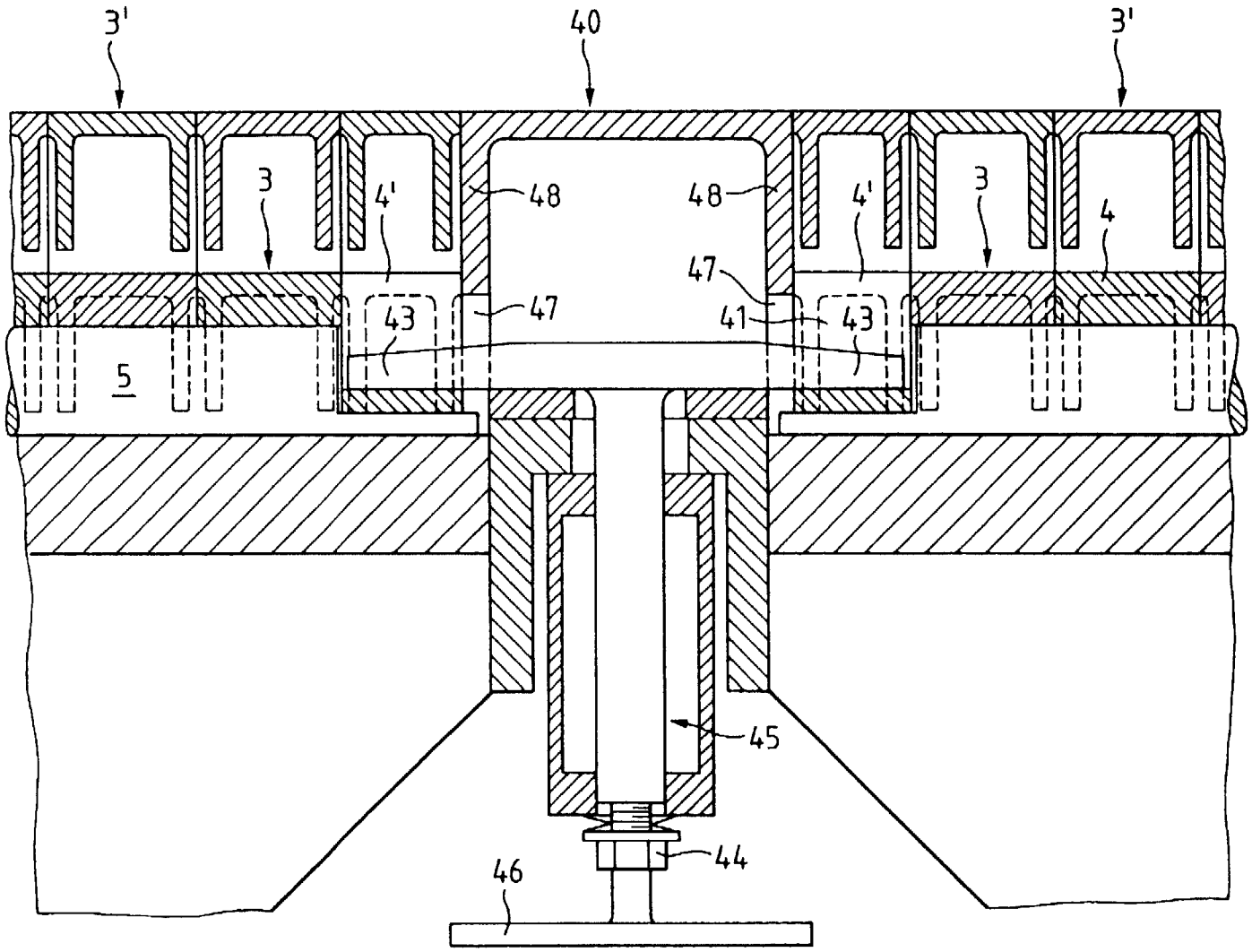

The invention is explained in greater detail below with reference to the drawings, which merely illustrate an exemplary embodiment and in which:

FIG. 1 is a view in perspective of a grate according to the invention,

FIG. 2 shows a part of a longitudinal section, extending in each case between two grate bars, through the middle region of the grate shown in FIG. 1, FIG. 3 shows a part of a corresponding longitudinal section extending in each case between an edge bar and the next grate bar, FIG. 4 shows an interrupted cross-section through a row of fixed bars and the connection means between the grate bars and swivelling prevention fastenings or swivelling prevention and longitudinal fastenings of the edge bars, FIG. 5 shows a cross-section in the edge region through a swivelling prevention and longitudinal fastening of an edge bar according to another embodiment, FIG. 6 shows a longitudinal section through the fastened edge bar shown in FIG. 5, FIG. 7 shows another longitudinal section through the fastened edge bar shown in FIG. 5, FIG. 8 shows a cross-section in the edge region through a swivelling prevention and longitudinal fastening of a fastened edge bar according to another embodiment, FIG. 9 shows a longitudinal section through the fastened edge bar shown in FIG. 8, FIG. 10 shows a cross-section in the edge region through a longitudinal fastening of a fastened edge bar, FIG. 10*a* shows a part of the cross-section according to FIG. 10, with the longitudinal fastening partly released, FIG. 11 shows a cross-section in the edge region through a longitudinal fastening of an edge bar according to another embodiment, FIG. 12 shows a part of a longitudinal section similar to FIG. 3, but in the case of a modified embodiment having a middle beam, the longitudinal section extending in each case between an edge bar on the middle beam and the next following grate bar, and also through a longitudinal fastening according to another embodiment, and FIG. 13 shows a cross-section through the middle beam shown in FIG. 12, with the grate bars adjoining on both sides and the longitudinal fastening.

FIG. 1 shows in an oblique top view a grate according to the invention, comprising a grate track 1, which is bounded on both sides by side walls having side cheeks 2 pressed into contact with limited lateral movability. It may also comprise two or more grate tracks arranged side by side and separated by middle beams.

The grate track 1 consists of rows 3 of fixed bars and rows 3' of movable bars, which alternate in the longitudinal direction and which in each case are formed by grate bars 4 arranged side by side. The rear ends of the grate bars 4 rest in each case (FIG. 2) on a grate bar carrier 5, which here is in the form of a rod of circular cross-section, which they embrace by a front stop lug 6*a* and a rear stop lug 6*b*, said lugs projecting downwards and limiting the longitudinal movability of the grate bar 4 relative to the grate bar carrier 5, the latter being embraced alternately in the transverse direction by the stop lugs 6*a, b* of the grate bars 4 semicircularly with a close fit or (not illustrated) in a half oval shape with spacing, that is to say giving the grate bar 4 some clearance in the longitudinal direction, so that grate bars lying side by side are slightly movable in the longitudinal direction relative to one another. In any case the grate bars 4 simply rest on the grate bar carriers 5, so that on being lifted they are detachable and movable laterally.

At the front end a forwardly rising surface 7 of the grate bar 4 is in each case bent over downwardly and forms a front surface 8, which is directed approximately at right angles to the surface 7. The grate bars 4 of a row 3, 3' of grate bars lie in each case with the front end on the surface of a grate bar 4 of the next row 3'; 3 of grate bars, that is to say the grate bars of a fixed bar row 3 lie on those of a movable bar row 3', and vice versa.

The movable bar rows 3' are caused by the grate bar carriers 5 on which their grate bars rest, and which are swivellably suspended and are driven, for example, by pistons 9 (FIG. 1, only one being shown), to make a reciprocating cyclical movement in the longitudinal direction, the movements of successive movable bar rows 3' being in each case displaced in phase by 180°. This means that, for example, every second movable bar row 3' is moved forwards, while at the same time the movable bar rows 3' lying in between are pulled back (in FIGS. 2, 3, 9, 12 the movable bar rows 3' are in each case shown in solid lines in one limit position and in dot-dash lines in the other limit position). Through these oppositely directed movements the material to be burned is uniformly and reliably raked and moved forward.

The grate bars 4 are in each case connected on both sides to their nearest neighbours by couplings. Each grate bar 4 has two side ribs 10 projecting downwards at the side edges. In the case of every second grate bar 4 of a fixed bar row 3 there is provided in each of the side ribs 10 a bore 11 (FIG. 4) into which a bolt 12, which is directed transversely to the longitudinal direction, is inserted and held fast by a nut 13. The grate bars 4 lying in between have at the same height longitudinal slots 14 which are open at the rear and through which projects in each case the bolt 12 inserted through the bore 11 in the neighbouring bar and carrying a head 15 at its end. Apart from slight clearance, the bolt 12 prevents mutual swivelling of neighbouring grate bars about the grate bar carrier 5, while at the same time the head 15 and the nut 13 act as transverse locking means overlapping the edges of the bore 11 and of the longitudinal slot 14 respectively and limiting the lateral distance between neighbouring grate bars. Owing to the fact that at one of the two grate bars 4 which it connects each bolt 12 projects through a longitudinal slot 14 open at the rear, a slight relative movement of neighbouring grate bars in the longitudinal direction is not prevented. In addition, the connection between neighbouring grate bars can in principle be released by pulling forward the grate bar provided with longitudinal slots 14 until the bolt 12 is disengaged. In operation, however, this is prevented by the rear stop lug **6*b*. In the same way neighbouring grate bars can in principle be swivelled about the bolt 12**.

The grate bars 4 of the movable bar rows 3' are connected in the same way. In contrast to the movable bar rows 3', in the case of the fixed bar rows 3 the edge bar which adjoins a wear plate 16 on the side cheek 2 (FIGS. 3, 4), and which is of similar construction to the other grate bars 4 and belongs to the group provided with longitudinal slots 14 in the side ribs 10, is a fixed grate bar 4' connected to the side cheek 2 by a swivelling prevention fastening of the same construction as the coupling acting between neighbouring grate bars. It consists of a locking means in the form of a bolt 12', which projects through a bore 11' extending through the wear plate 16 and the side cheek 2 and is fastened to the side cheek 2 by means of a nut 13' screwed onto its outer end. The slightly thicker inner end carries a head 15' lying inside the side rib 10, so that it not only prevents the swivelling of the edge bar 4' about the grate bar carrier 5 by cooperating with the bottom edge of the longitudinal slot 14 as a stop surface, but also limits the distance between said bar and the wear plate 16, the head 15' forming a stop as transverse locking means together with the inner side, remote from the side wall, of the side rib 10. However, because of the above-described connections between neighbouring grate bars, the fastened grate bar 4' and the edge bar lying opposite, which is likewise fastened—in the same or some other way—also secure against swivelling the other grate bars 4 of the same fixed bar row 3 which lie between them.

In contrast to the other grate bars 4, the fastened grate bars 4' of the fixed bar rows 3 are not provided with rear stop lugs **6*b*. In order to ensure that they cannot move out of position during operation, however, a longitudinal fastening is provided in each case to prevent movement in the longitudinal direction. The longitudinal fastening has in each case a configuration such that it can be operated from the region situated at the side of the grate track 1**.

In the simplest case, the swivelling prevention fastening has a configuration such that it can at the same time be used as a longitudinal fastening. In the arrangement of the same which is described, the firm tightening of the nut 13' for example pulls the bolt 12' towards the outside, so that the fastened grate bar 4' is clamped fast between its head 15' and the wear plate 16 and immovably fastened. If the nut 13' is loosened, the longitudinal fastening is disengaged, but this is not true of the swivelling prevention fastening, which is released only when the grate bar 4' is pushed forwards. Instead of the nut 13', other clamp means, for example an eccentric clamping device, can also be used.

In another configuration of a swivelling prevention fastening, which at the same time acts as a longitudinal fastening, a locking means (FIGS. 5 to 7) directed transversely to the longitudinal direction of the grate track 1 consists of a cam sleeve 18 and a rotatable rod 19 which is surrounded by the latter and has at its end two symmetrically arranged locking cams 20 form a transverse locking means which does not project radially beyond the cam sleeve 18. Said cam sleeve 18, which is fastened by a nut 21 in a bore 22 formed in the side cheek 2 and also extending through the wear plate 16, extends to a point in front of a closed slot 23 formed in the side rib 10 of the fastened grate bar 4' and widened in the middle, but at the sides has two fastening cams 24 which project into the slot 23 and snugly fill its end regions, while the rotatable rod 19, held fast by a fastening nut 25 in the cam sleeve 18, projects through the slot 23, and the locking cams 20 laterally overlap the edge of the latter on the inside of the side rib 10.

By means of the fastening cams 24 the fastened grate bar 4' is secured against swivelling about the grate bar carrier 5 and against longitudinal displacement, while the locking cams 20 limit the distance between it and the wear plate 16.

In order to release the fastening, the fastening nut 25 is first released and the rotatable rod 19 is turned by 90°, so that the locking cams 20 come into line with the slot 23. The nut 21 is then also released, and the entire locking device is pulled back. The swivelling prevention and longitudinal fastening is activated correspondingly.

In another embodiment (FIGS. 8, 9) the locking means is in the form of a rotatable rod 19 which can be fastened by a fastening nut 25, but which is directly mounted in a bore 22 extending through the side cheek 2 underneath the wear plate 16 and at its end situated outside the side cheek 2 is provided with a turning lever 26 and at the opposite end, which extends through a recess 27 in the bottom edge of the side rib 10 of the fastened grate bar 4', with a single locking cam 20 as transverse locking means. Since the fastening nut 25 exerts an outwardly directed pull on the rotatable rod 9, the locking cam 20, which on the inner face of the side rib 10 overlaps the front edge of the recess 27, presses the fastened grate bar 4' against the wear plate 16 and thus clamps it fast. In order to release this swivelling prevention and longitudinal fastening, the fastening nut 25 is released and thereupon the rotatable rod 19 is turned (FIG. 9) until the side rib 10 is freed from the locking cam 20.

In other embodiments the longitudinal fastening is separate from the swivel prevention fastening, which can correspond to the first embodiment (FIG. 4), with a bolt 12' which is secured by the nut 13' but is not subjected to a pull effecting the clamping of the fastened edge bar 4'. Thus, the side ribs 10 of the fastened grate bar 4' may have aligned bores 28 (FIGS. 3, 10, **10*a*) which are formed slightly in front of the rear end and through which a locking pin 29** directed transversely to the longitudinal direction projects. It also extends through a bore 30, lying in line with the bores 28, in a bracket 31 which projects between the side ribs 10 of the fastened grate bars 4' and is mounted on the grate bar carrier 5 of the corresponding fixed bar row 3. This longitudinal fastening permits lateral displacement of the fixed grate bar 4', but this displacement is limited by the swivelling prevention fastening. In addition, it fixes the position of said bar relative to the corresponding (stationary) grate bar carrier 5 and hence also of the other stationary parts of the grate.

The locking pin 29 projects through an air opening 32 in the side cheek 2 into a securing tube 34 which is closed at the outer end by a cover 33 and which is screwed into an opening 35 on the outside of the side cheek 2. After an inspection door 36 has been opened, said tube can be unscrewed (FIG. 10*a*) by means of a spanner applied to a hexagon 37 fastened on the outside to the cover 33, whereupon the locking pin 29 can be pulled out, for example with the aid of pliers, and the longitudinal fastening can thus be released.

Many variants of a longitudinal fastening of this kind are of course possible, and in particular other constructional solutions can be selected instead of the bores 28, 30, the decisive point being that the locking pin cooperates with a rearward-facing holding surface on the grate bar carrier and with a forward-facing locking surface on the edge bar, which surfaces in the present case are formed by the front and rear side walls of the bores 30 and 28 respectively.

However, there are also solutions which differ further from that described. Thus (FIG. 11), the longitudinal fastening can secure the fastened grate bar 4' directly relative to the side cheek 2, instead of the grate bar carrier 5, for example by means of a locking pin 29 screwed into a threaded bore 38 in the side cheek 2 and secured by a fastening nut 39.

Separation of the swivelling prevention fastening and the longitudinal fastening, as illustrated in the last two examples, permits constructional solutions which are particularly simple in construction and are very reliable even under the difficult conditions prevailing in the region of a grate.

In another constructional solution for the longitudinal fastening (FIGS. 12, 13), which is suitable above all for fastening the edge bars 4' on the middle beam 40 of a grate comprising two grate tracks, because it takes up very little space, in particular transversely to the longitudinal direction, too, the edge bar has at the rear end a recess 41 which is open at the top and extends transversely to the longitudinal direction and whose rear boundary is formed by a forward-facing locking surface 42. A locking means 43 comprising a transverse beam of a T-shaped holding-down means 45 fastened on the middle beam 40 with the aid of a nut 44 and provided at its bottom end with a turning lever 46, engages on both sides of the middle beam 40—via openings 47 in side plates 48 of the middle beam 40, which form side walls laterally bounding the rows of grate bars—in the recess 41 of the respective edge bar 4', presses the rear end of the latter against the grate bar carrier 5 and by this clamping action fastens it against longitudinal displacement. The longitudinal position of the edge bar 4' is in addition secured by the locking surface 42. After the nut 44 has been released, however, the holding-down means 45 can be raised until the locking surface 42 is freed from the locking means 43. The swivelling prevention fastening has a configuration identical to that at the outer edge.

When both the swivelling prevention fastening and the longitudinal fastening have been activated, the edge bars 4' of the fixed bar rows 3 are fastened in such a manner that they have only slight play in respect of swivelling about the grate bar carrier 5 and also in respect of lateral displacement. The same applies to the respective couplings acting between neighbouring grate bars, so that through the fastening of the two edge bars 4' an entire fixed bar row 3 is in each case fastened in respect of swivelling about its grate bar carrier 5.

The movable bar rows 3' have some play in this respect, it is true, but this is in each case limited by the overlapping fixed bar row 3 situated directly behind it. They cannot be swivelled up sufficiently far to enable dangerous gaps to be opened up in the grate surface.

Since the side cheeks 2 are slightly movable sideways and are pressed by elastic force against the grate bar rows, they can compensate for fluctuations in the width of the grate bars 4, and therefore of the grate bar rows, which are caused by temperature fluctuations. If the grate bars 4 contract as the temperature falls, the couplings between neighbouring grate bars at the same time ensure by means of their transverse locking means that the lateral distance between them remains slight and that no wide gaps are formed between neighbouring grate bars.

If it is now necessary for any particular grate bar 4 to be changed or inspected, in the case of a grate having two grate tracks separated by a middle beam and separate longitudinal fastening, according to FIGS. 10 and 10*a*—the procedure is similar when there is only one grate track—in the next two or three fixed bar rows 3 lying behind the grate bar row containing the grate bar 4 to be replaced, the longitudinal fastenings on the side cheek 2 are released by removing the locking pin 29 as already described. The edge bar 4' is then pushed forward on the side cheek 2 by means of a slightly bent rod introduced through the air opening 32, so that its front end can be gripped by means of a hook or the like at the surface of the grate, and it can be pulled out and removed, while the swivelling prevention fastening and the coupling to the neighbouring grate bar are released by releasing the engagement of the bolts 12',12 in the longitudinal slots 14. Similarly, at the middle beam 40 the longitudinal fastening is released and the edge bar 4' is pushed forward by the locking means 43, by turning the holding-down means 45 accordingly with the aid of the turning lever 46.

In the case of swivelling prevention and longitudinal fastenings which are released simultaneously in respect of both degrees of freedom (embodiments according to FIGS. 5 to 7 and FIGS. 8 and 9), the fastened grate bar 4' can then be raised directly by means of a hook or lever.

Finally, the released fixed bar rows 3 and the movable bar rows 3' not fastened, starting with the rearmost, are swivelled up by taking advantage of their limited play. As far as the grate bar row in which the grate bar 4 to be removed is situated, the plays of the grate bar rows lying therebehind are cumulative, so that the grate bar 4 in question can be raised so far that the rear stop lug 6*b* can be raised above the grate bar carrier 5 and the grate bar 4 can be pulled out towards the front. If it belongs to the group of grate bars provided with longitudinal slots 14 open at the rear, it can be removed alone, otherwise being removed together with its two adjoining grate bars.

The insertion of a new grate bar 4, or of the repaired or only inspected grate bar 4, is effected in corresponding fashion. The entire operation requires no entry into the under-grate blast region. The longitudinal fastenings can be operated from the region situated outside the side cheek 2 and under the middle beam 40. The removal of the grate bar 4 which is to be replaced and the insertion of the same or a corresponding grate bar 4 are effected from the surface of the grate.

We claim:

1. Grate for a furnace having at least one grate track (1) comprising a plurality of fixed bar rows (3) and movable bar rows (3') alternating in the longitudinal direction and bounded on both sides by side walls, said rows comprising grate bars (4) which are arranged side by side and which are connected, in a swivellable and laterally movable manner, in the region of their rear ends respectively to a stationary and to a movable grate bar carrier (5), but in the longitudinal direction have at most limited movability, while at their front end they rest on a grate bar (4) of the next grate bar row (3'; 3), the grate bars (4) of a grate bar row (3, 3') being in each case connected by connection means arranged under the surface (7) of the latter, in such a manner that neighbouring grate bars (4) have, in relation to one another, at most limited lateral movability and at most slight swivellability about the grate bar carrier (5), characterized in that in each fixed bar row (3) at least one fastened grate bar (4') is provided, which with the aid of holding means acting under the surface of the fixed bar row (3) is fastened such that it is neither movable in the longitudinal direction nor swivellable in the upward direction, the holding means being releasable, at least in respect of movability in the longitudinal direction, from the region situated outside a side wall.

2. Grate according to claim 1, characterized in that the at least one fastened grate bar (4') is in each case an edge bar.

3. Grate according to claim 2, characterized in that in each case the two edge bars of a fixed bar row (3) are fastened.

4. Grate according to claim 2, characterized in that in each case the holding means limit the distance between the fastened grate bar (4') and the adjoining side wall.

5. Grate according to claim 1 characterized in that the holding means comprise in each case a releasable swivelling prevention fastening having at least one locking means which is aligned approximately transversely to the longitudinal direction and is anchored in a side wall, and which projects over an upward-facing stop surface on the fastened grate bar (4').

6. Grate according to claim 4, characterized in that the locking means comprises a transverse locking means which overlaps a surface, remote from the side wall, on the fastened grate bar (4').

7. Grate according to claim 5, characterized in that the locking means projects through a longitudinal slot (14), open at the rear, in the fastened grate bar (4').

8. Grate according to claim 7, characterized in that the locking means ms in the form of a bolt (12') and the transverse locking means is in the form of a disc.

9. Grate according to claim 6, characterized in that the swivelling prevention fastening has clamping means which can be released from the region situated outside the side wall and which exert on the transverse locking means a pull directed towards the side wall.

10. Grate according to claim 6, characterized in that the transverse locking means is mounted on a rotatable rod (19) anchored rotatably in the side wall, and its engagement with the fastened edge bar (4') can be released by the turning of the rotatable rod (19).

11. Grate according to claim 10, characterized in that the rotatable rod (19) projects through a closed slot (23) in the fastened grate bar (4').

12. Grate according to claim 11, characterized in that the locking means comprises a cam sleeve (18), which surrounds the rotatable rod (19) and has two fastening cams (24) projecting into the slot (23), so that it fills the latter in the longitudinal direction.

13. Grate according to claim 5, characterized in that the holding means comprise a longitudinal fastening which is separate from the swivelling prevention fastening and is releasable from the region situated outside a side wall, and which prevents longitudinal movement of the fastened grate bar (4') relative to the grate bar carrier (5), while after the longitudinal fastening has been released said bar can be pushed forwards in the longitudinal direction and the swivelling prevention fastening can thereby be released.

14. Grate according to claim 13, characterized in that the longitudinal fastening comprises a locking means (29; 43) which is directed at least approximately transversely to the longitudinal direction and which cooperates with a forward-facing locking surface on the fastened grate bar (4').

15. Grate according to claim 14, characterized in that the locking means (29) can be pulled back through the side wall in order to release the longitudinal fastening.

16. Grate according to claim 15, characterized in that the fastened grate bar (4') has at least one bore (28) into which the locking means (29 projects.

17. Grate according to claim 14, characterized in that the locking means (29) cooperates with a rearwardly directed holding surface on the grate bar carrier (5).

18. Grate according to claim 17, characterized in that a bore (30) which is formed in a bracket (31) on the grate bar carrier (5), and into which the locking means (29) also projects, lies in line with the at least one bore (28) in the fastened grate bar (4').

19. Grate according to claim 15, characterized in that that end of the locking means (28) which lies near the wall projects movably through an opening in the side wall and is there secured in the fastening position by a removable barrier.

20. Grate according to claim 15, characterized in that the locking means (29) is screwed into a threaded bore (38) in the side wall.

21. Grate according to claim 14, characterized in that the locking means (43) engages in a recess (41), open at the top, in the fastened grate bar (4') and can be raised in order to release the longitudinal fastening.

22. Grate according to claim 21, characterized in that the locking means (43) is in the form of a transverse beam of a T-shaped holding-down means (45) which, after the locking means (43) has been raised, can be turned about a vertical axis in such a manner that the locking means (43) pushes forward the fastened grate bar (4').

23. Grate according to claim 1, characterized in that the grate bars (4) are in each case merely laid on the grate bar holder (5), their longitudinal movability being in each case limited by a front, downwardly projecting stop lug (6*a*) in front of the grate bar holder (5) and, except possibly in the case of the fastened grate bars (4'), by a downwardly projecting rear stop lug (6*b*) behind the grate bar holder (5).

24. Grate according to claim 1, characterized in that the connection means for connecting the grate bars (4) to one another have a configuration such that they permit the swivelling of connected grate bars (4) in relation to one another about a transverse axis extending in front of the grate bar carrier (5) and can be released by longitudinal movement of the grate bars (4) relative to one another.

25. Grate according to claim 24, characterized in that the connection means consist of individual couplings which in each case connect two neighbouring grate bars (4).

26. Grate according to claim 24, characterized in that the coupling is in each case in the form of a bolt (12) which is directed transversely to the longitudinal direction and which projects through at least one bore (11) in at least one grate bar (4) and through at least one longitudinal slot (14), open at the rear, in at least one other grate bar (4) and carries transverse locking means at the ends.

* * * * *

UNITED STATES PATENT AND TRADEMARK OFFICE
CERTIFICATE OF CORRECTION

PATENT NO. : 5,538,128

DATED : July 23, 1996

INVENTOR(S) : STIERLI et al.

It is certified that error appears in the above-identified patent and that said Letters Patent is hereby corrected as shown below:

On the title page Items [19] and [75]
Correct the spelling of the first-named inventor to --STIERLI--.

Signed and Sealed this

Twenty-second Day of October, 1996

*Attest:*

BRUCE LEHMAN

*Attesting Officer*

*Commissioner of Patents and Trademarks*